US008798303B2

(12) United States Patent
Hsu Huang et al.

(10) Patent No.: US 8,798,303 B2
(45) Date of Patent: Aug. 5, 2014

(54) HORN AMPLIFIER

(71) Applicant: Jazz Hipster Corporation, New Taipei (TW)

(72) Inventors: Yueh-Hua Hsu Huang, New Taipei (TW); Yuji Itabashi, New Taipei (TW)

(73) Assignee: Jazz Hipster Corporation, New Taipei (TW)

( * ) Notice: Subject to any disclaimer, the term of this patent is extended or adjusted under 35 U.S.C. 154(b) by 2 days.

(21) Appl. No.: 13/657,216

(22) Filed: Oct. 22, 2012

(65) Prior Publication Data

US 2014/0112513 A1 Apr. 24, 2014

(51) Int. Cl.
*H04R 1/02* (2006.01)

(52) U.S. Cl.
USPC ..... 381/340; 381/342; 381/382

(58) Field of Classification Search
USPC ..... 381/337, 338, 339, 340, 341, 342, 345, 381/346, 350, 351, 382; 181/177, 182, 185, 181/187, 188, 189, 192, 193, 194, 195, 152, 181/159, 199
See application file for complete search history.

(56) References Cited

U.S. PATENT DOCUMENTS

| | | | | |
|---|---|---|---|---|
| 7,177,437 | B1 * | 2/2007 | Adams | 381/340 |
| 7,650,006 | B2 * | 1/2010 | Isotalo | 381/340 |
| 7,735,599 | B2 * | 6/2010 | Kubota | 181/192 |

* cited by examiner

*Primary Examiner* — Davetta W Goins
*Assistant Examiner* — Amir Etesam
(74) *Attorney, Agent, or Firm* — Ming Chow; Sinorica, LLC

(57) ABSTRACT

A horn amplifier comprises a horn and at least one speaker member with at least one spherical sound source; wherein the horn has one throat portion and one voice port opened from the throat portion toward outside, the bottom surface of the inner side of the throat portion of the horn has an open, the spherical sound source of the speaker member connects with the open, the inner side of the throat portion has at least one S-type sound-guide board, the sound-guide board is made as a plurality of paths in order to let spherical sound waves from the spherical sound source of the speaker member enter into the paths, then the spherical sound waves are transformed into plane sound waves, the plane sound waves are delivered to outside through the inner structure of the horn.

5 Claims, 24 Drawing Sheets

HORN AMPLIFIER

BACKGROUND OF THE INVENTION

1. Field of the Invention

The present invention generally relates to a horn amplifier, more particularly to a horn amplifier that transforms spherical sound waves to plane sound waves via inner paths, and the plane sound waves are able to lower high-frequency attenuation of outputting sound waves.

2. Description of the Prior Art

Nowadays, people gradually put their focus on how to promote their life due to raising consumers' abilities, more particularly to leisure life. While at the moment of physical and mental fatigues, listening music via sitting or lying is the best lifestyle for releasing pressures.

Consumers will generally listen to all kinds of wonderful music in concert halls or performance venues, and a general concert hall or performance venue will use horn speakers to play music. Since the horn speaker applies natural physical theories, it is the most advanced speaker compared to other types of speakers. In practice, the horn speaker uses vibrations to produce sound waves and then transmits the sound waves to remote via a corn member so as to let remote audiences listen music very clear.

Although the prior horn speaker is capable of amplifying and transmitting sound to remote, and manufacturers design many different kinds of inner structures in order to promote sound pressures, such horn speakers may cause lowering high-frequency attenuation. Therefore, to design a horn amplifier that is able to increase sound pressure and improve the problem of high-frequency attenuation will be a best solution.

SUMMARY OF THE INVENTION

The main objective of the present invention is to provide a horn amplifier that transforms spherical sound waves to plane sound waves through a plural paths inside thereof, and the plane sound waves are able to lower high-frequency attenuation while in output.

To reach aforesaid objective, a horn amplifier comprises a horn and at least one speaker member with at least one spherical sound source; wherein the horn has one throat portion and one voice port opened from the throat portion toward outside, the bottom surface of the inner side of the throat portion of the horn has an open, the spherical sound source of the speaker member connects with the open, the inner side of the throat portion has at least one S-type sound-guide board, the sound-guide board is made as a plurality of paths in order to let spherical sound waves from the spherical sound source of the speaker member enter into the paths, then the spherical sound waves are transformed into plane sound waves, the plane sound waves are delivered to outside through the inner structure of the horn.

In practice, the S-type sound-guide board is assembled by two guide board.

In practice, the case of the throat portion is shaped as S-type, the inner side of the throat portion has two S-type walls.

In practice, the two sides of the guide board of the S-type sound-guide board connect with the two S-type walls respectively.

In practice, the spherical sound waves from the spherical sound source of the speaker member enter into the paths made by the S-type sound-guide board, then the spherical sound waves are transformed into plane sound waves so as to lower high-frequency attenuation of outputting the sound waves.

Except above first structure, the sound-guide board can be another structure. The horn amplifier comprises a horn and at least one speaker member with at least one spherical sound source; wherein the horn has one throat portion and one voice port opened from the throat portion toward outside, the bottom surface of the inner side of the throat portion of the horn has an open, the spherical sound source of the speaker member connects with the open, the inner side of the throat portion has at least one D-type sound-guide board, the sound-guide board is made as a plurality of paths in order to let spherical sound waves from the spherical sound source of the speaker member enter into the paths, then the spherical sound waves are transformed into plane sound waves, the plane sound waves are delivered to outside through the inner structure of the horn.

In practice, the D-type sound-guide board is assembled by two guide board.

In practice, the case of the throat portion is shaped as S-type, the inner side of the throat portion has two D-type walls.

In practice, the two sides of the guide board of the D-type sound-guide board connect with the two D-type walls respectively.

In practice, the spherical sound waves from the spherical sound source of the speaker member enter into the paths made by the D-type sound-guide board, then the spherical sound waves are transformed into plane sound waves so as to lower high-frequency attenuation of outputting the sound waves.

Except above two structures, the sound-guide board can be another structure. The horn amplifier comprises a horn and at least one speaker member with at least one spherical sound source; wherein the horn has one throat portion and one voice port opened from the throat portion toward outside, the bottom surface of the inner side of the throat portion of the horn has an open, the spherical sound source of the speaker member connects with the open, the inner side of the throat portion has at least one <-type sound-guide board, the sound-guide board is made as a plurality of paths in order to let spherical sound waves from the spherical sound source of the speaker member enter into the paths, then the spherical sound waves are transformed into plane sound waves, the plane sound waves are delivered to outside through the inner structure of the horn.

In practice, the <-type sound-guide board is assembled by two guide board.

In practice, the case of the throat portion is shaped as S-type, the inner side of the throat portion has two <-type walls.

In practice, the two sides of the guide board of the D-type sound-guide board connect with the two <-type walls respectively.

In practice, the spherical sound waves from the spherical sound source of the speaker member enter into the paths made by the <-type sound-guide board, then the spherical sound waves are transformed into plane sound waves so as to lower high-frequency attenuation of outputting the sound waves.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1A:
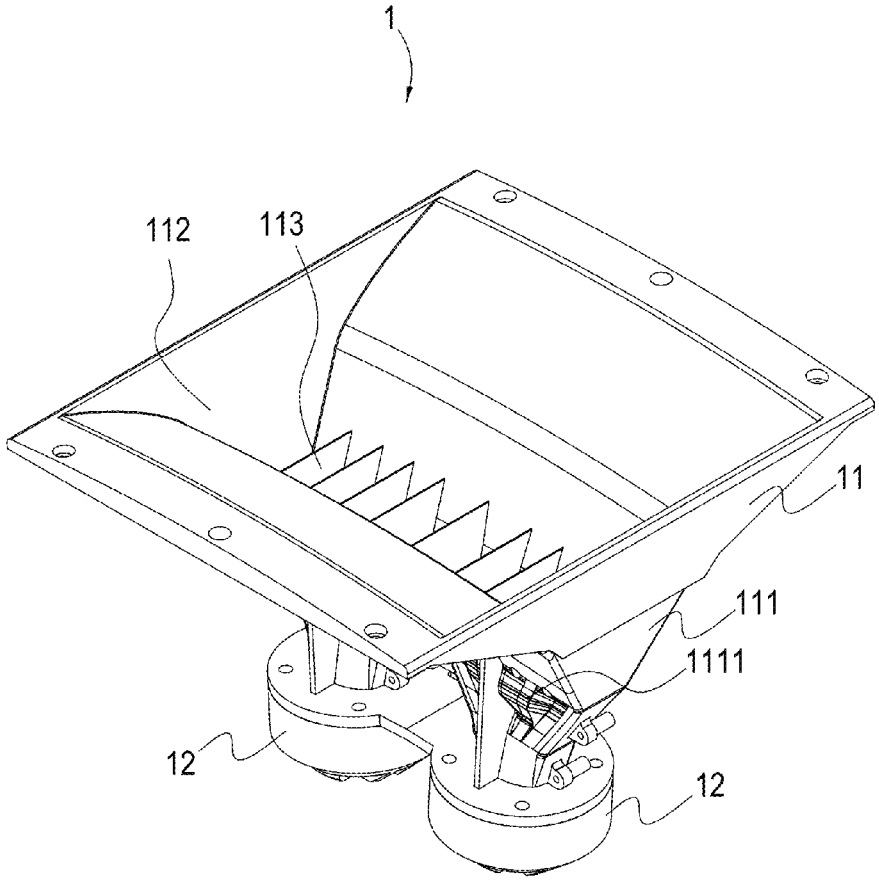
FIG. 1A illustrates a schematic structural view of the horn amplifier of the present invention.
Figure 1B:
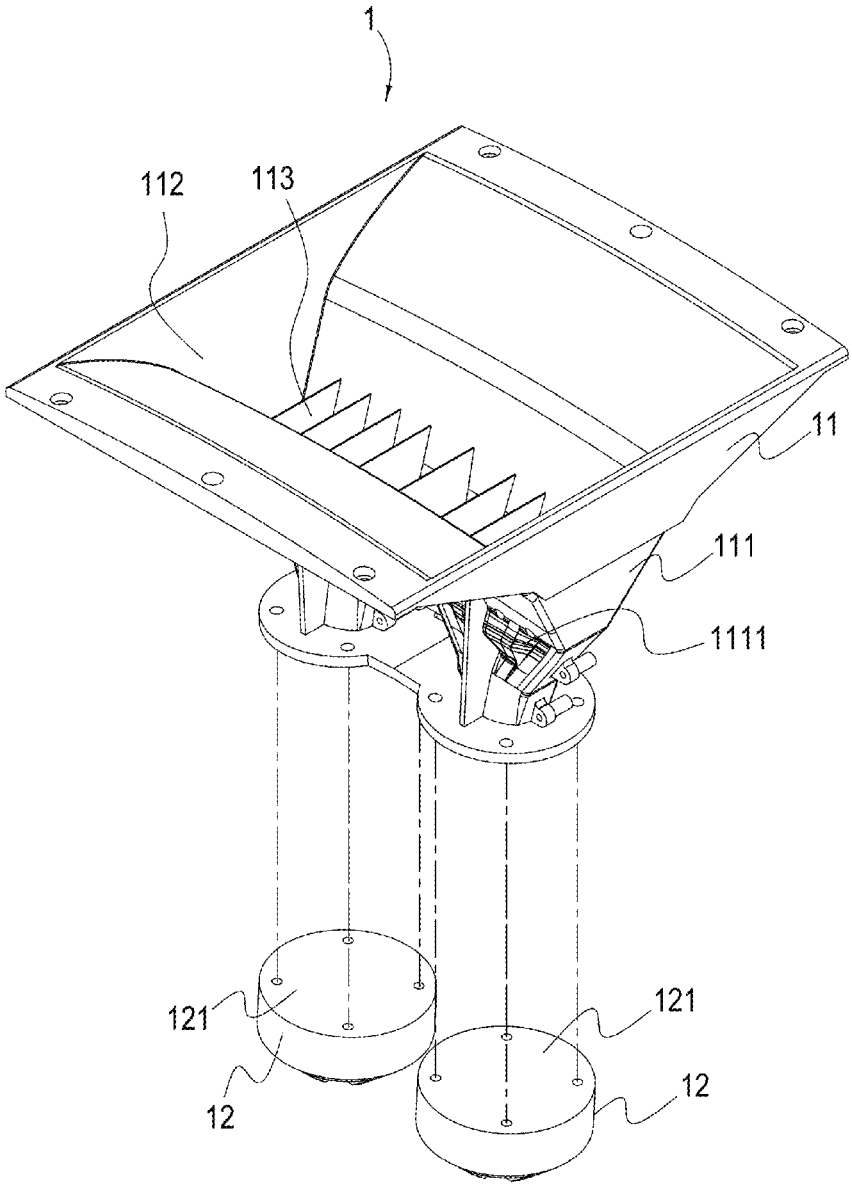
FIG. 1B illustrates a schematic exploded view of the horn amplifier of the present invention.
Figure 2:
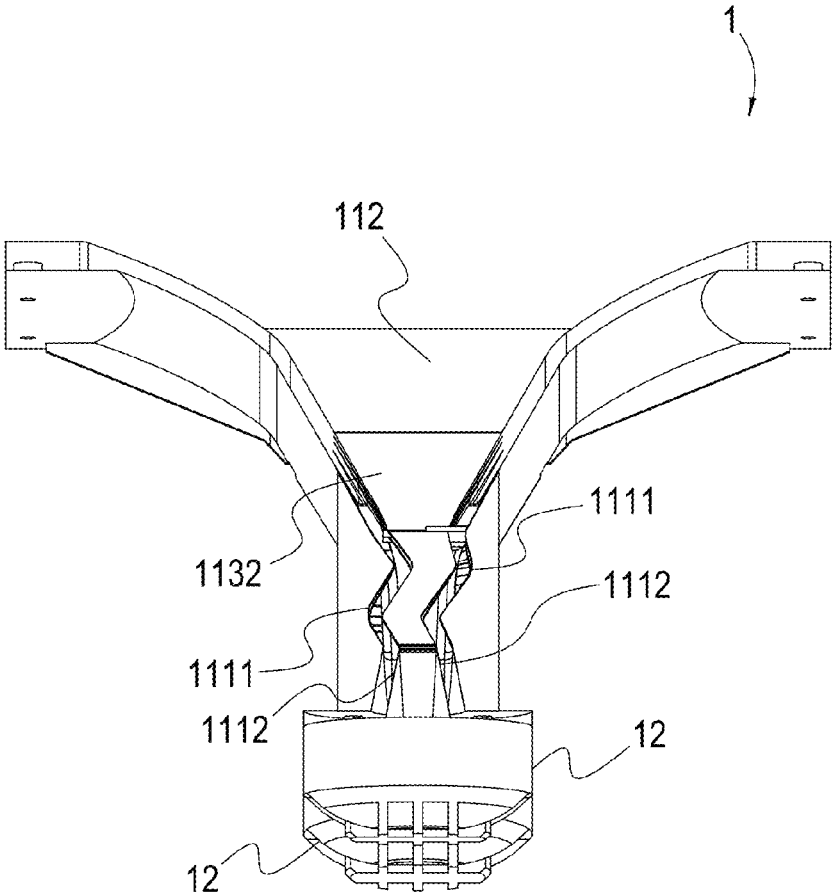
FIG. 2 illustrates a schematic sectional view of the horn amplifier of the present invention.
Figure 3:
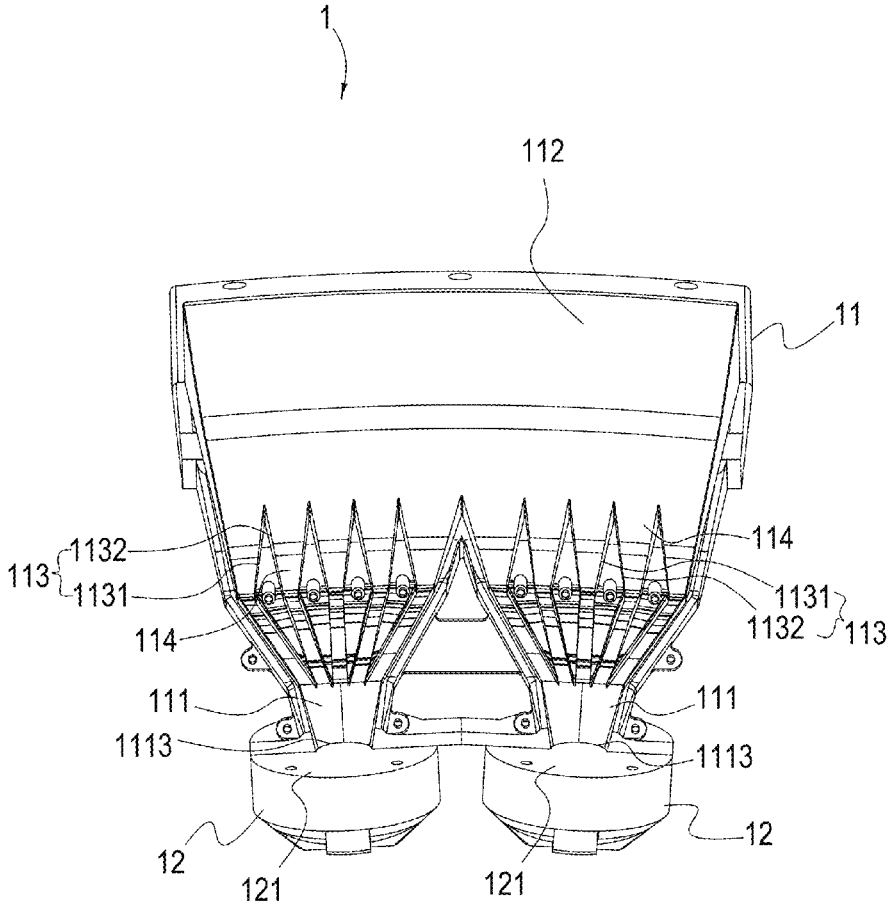
FIG. 3 illustrates a schematic sectional view of another view angle of the horn amplifier of the present invention.
Figure 4:
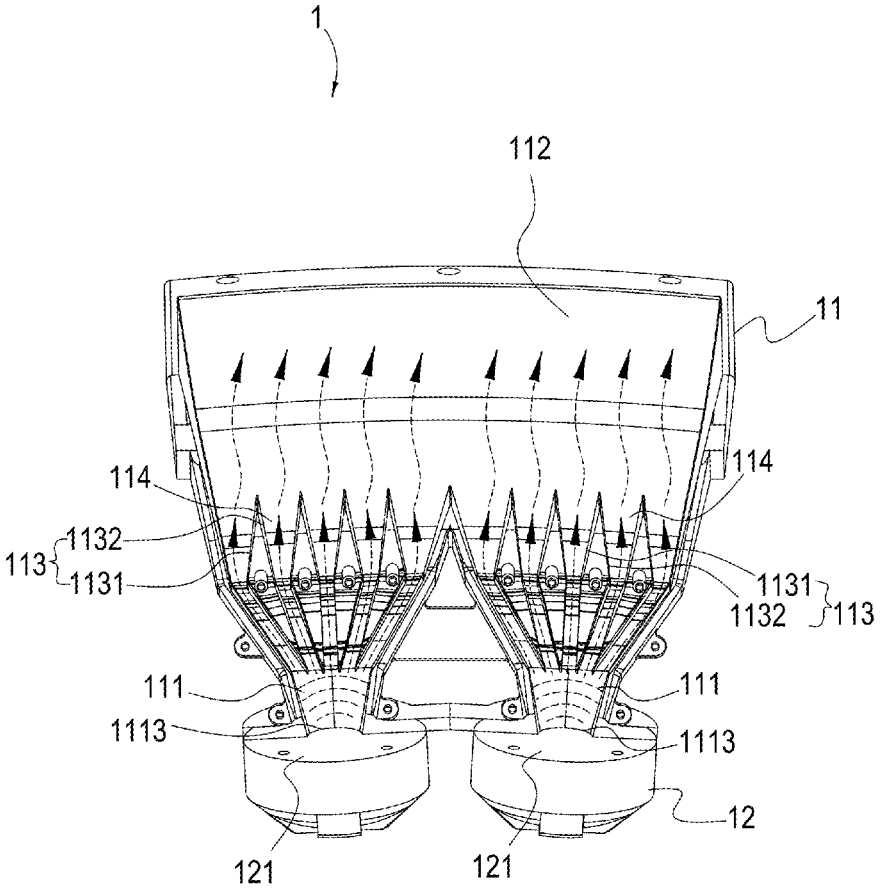
FIG. 4 illustrates a schematic application view of spherical sound waves transforming to plane sound waves of the horn amplifier of the present invention.

With reference to FIG. 1A, FIG. 1B and FIG. 2, which illustrates a schematic structural view of the horn amplifier of the present invention, a schematic exploded view of the horn amplifier of the present invention and a schematic sectional view of another view angle of the horn amplifier of the present invention. As shown in figures, the horn amplifier 1 includes a horn 11 and at least one speaker member 12 with at least one spherical sound source 121, wherein the horn 11 has at least one throat portion 111 and one voice port 112 opened from the throat portion 111 toward outside, is for the preferred embodiment, the horn 11 only has two throat portions 111, the bottom surface of the inner side of the throat portion 111 of the horn 11 has an open 1113 that is corresponding to a speaker member 12, in practice, one or more throat portions 111 with one or more speaker members 12 can be designed. According to FIG. 1B, the cases 1111 on the front and rear edges of the throat portion 111 can be an S type, D type or < type. Hence, As shown in FIG. 2 and FIG. 3, the two S-type cases 1111 forms two S-type walls 1112 inside the throat portion 111 (except for S-type, the case can be D-type or <-type, and two D-type or <-type walls are in the throat portion 111), the bottom surface of the inner side of the throat portion 111 has an open 1113, the spherical sound source 121 of the speaker member 12 connects with the open 1113, thus spherical waves from the spherical sound source 121 transmits to the throat portion 111 while the speaker member 12 vibrates, the inner side of the throat portion 111 has a plurality of sound-guide boards 113 between the open 1113 of the throat portion 111 and the voice port 112 of the horn 11 (the sound-guide board 113 can be S-type, D-type or <-type, there are four S-type sound-guide boards for the preferred embodiment), the sound-guide board 113 is constructed by two guide boards 1131 and 1132. The two guide boards 1131 and 1132 themselves are shaped as two curves in order to let the sound-guide board 113 be formed as an S-type (the sound-guide board 113 can be D-type or <-type as well), the two sides of the guide boards 1131 and 1132 connect with the two S-type (D-type or <-type) walls 1112 respectively. As shown in FIG. 4, is while the spherical sound waves from the spherical sound source 121 leave for the open 1113 of the throat portion 111, the spherical sound waves may enter into a plurality of paths 114 made by the plural sound-guide boards 113, then the spherical sound wave are transformed into plane sound waves. After the plane sound waves transmit out from the paths 114, the plane sound waves may continuously go to the voice port 112 for output along the inner structure of the horn 11.

Figure 5:
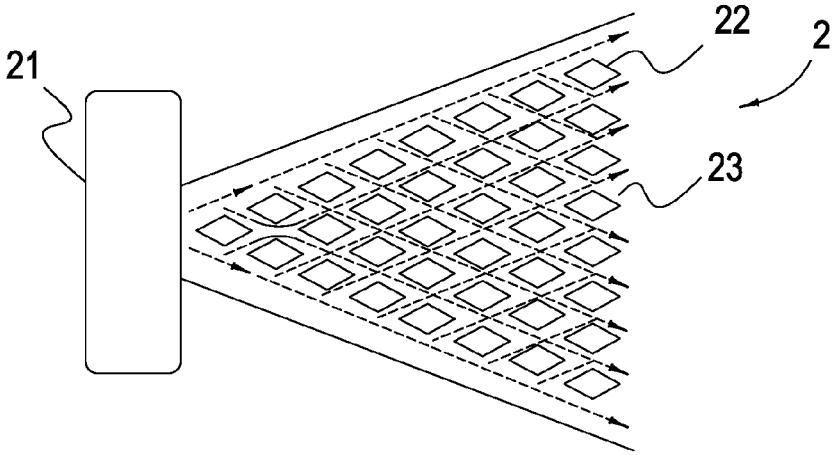
FIG.5 PRIOR ART
FIG. 5 illustrates a schematic inner structural view of a first horn is speaker of prior arts.
Figure 6:
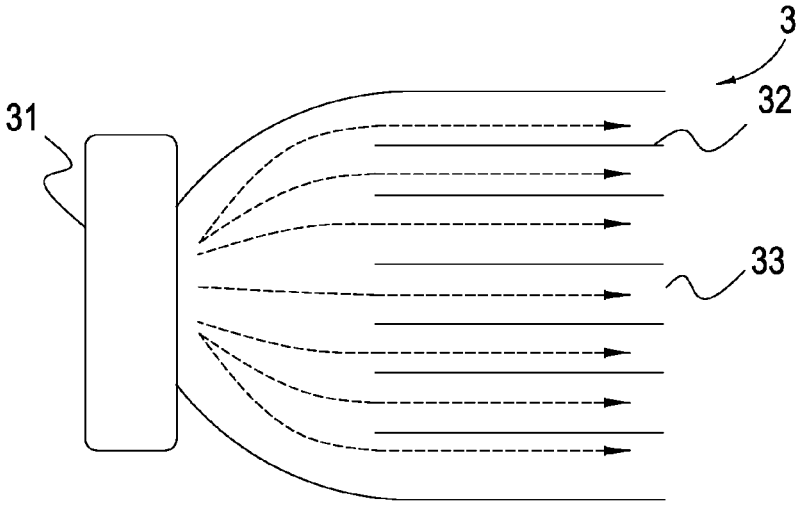
FIG.6 PRIOR ART
FIG. 6 illustrates a schematic inner structural view of a second horn speaker of prior arts.
Figure 7:
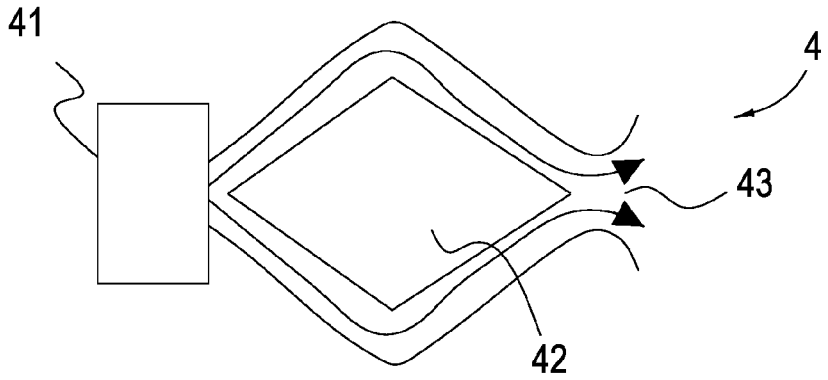
FIG. 7 PRIOR ART
FIG. 7 illustrates a schematic inner structural view of a third horn speaker of prior arts.
Figure 8A:
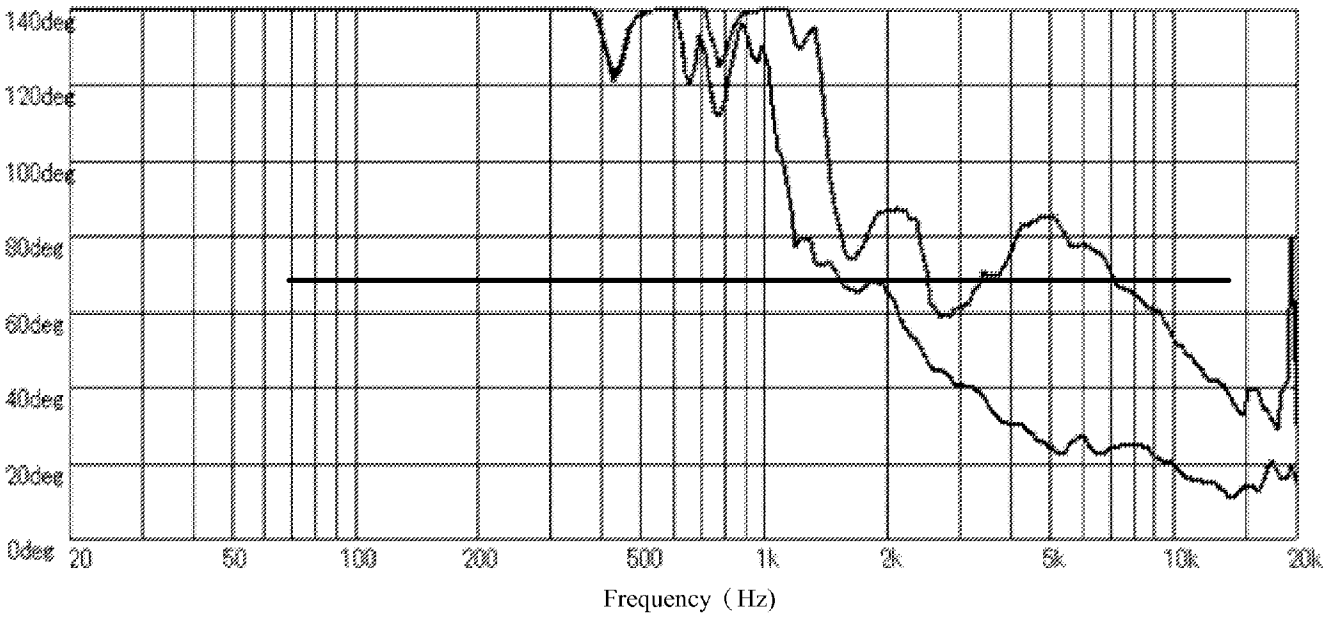
FIG. 8A PRIOR ART
FIG. 8A illustrates a phase and frequency measurement data figure of a directivity of the first horn speaker of prior arts.
Figure 8B:
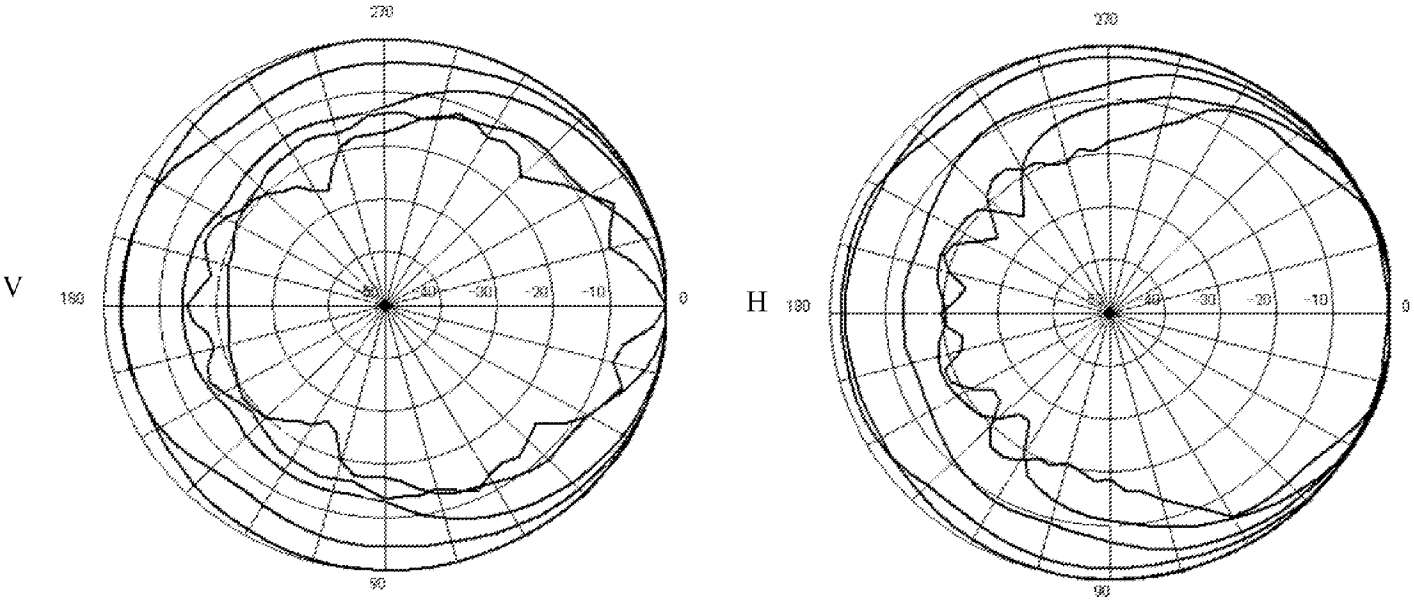
FIG.8B PRIOR ART
FIG. 8B illustrates a radiation field measurement data figure of the directivity of the first horn speaker of prior arts.
Figure 8C:
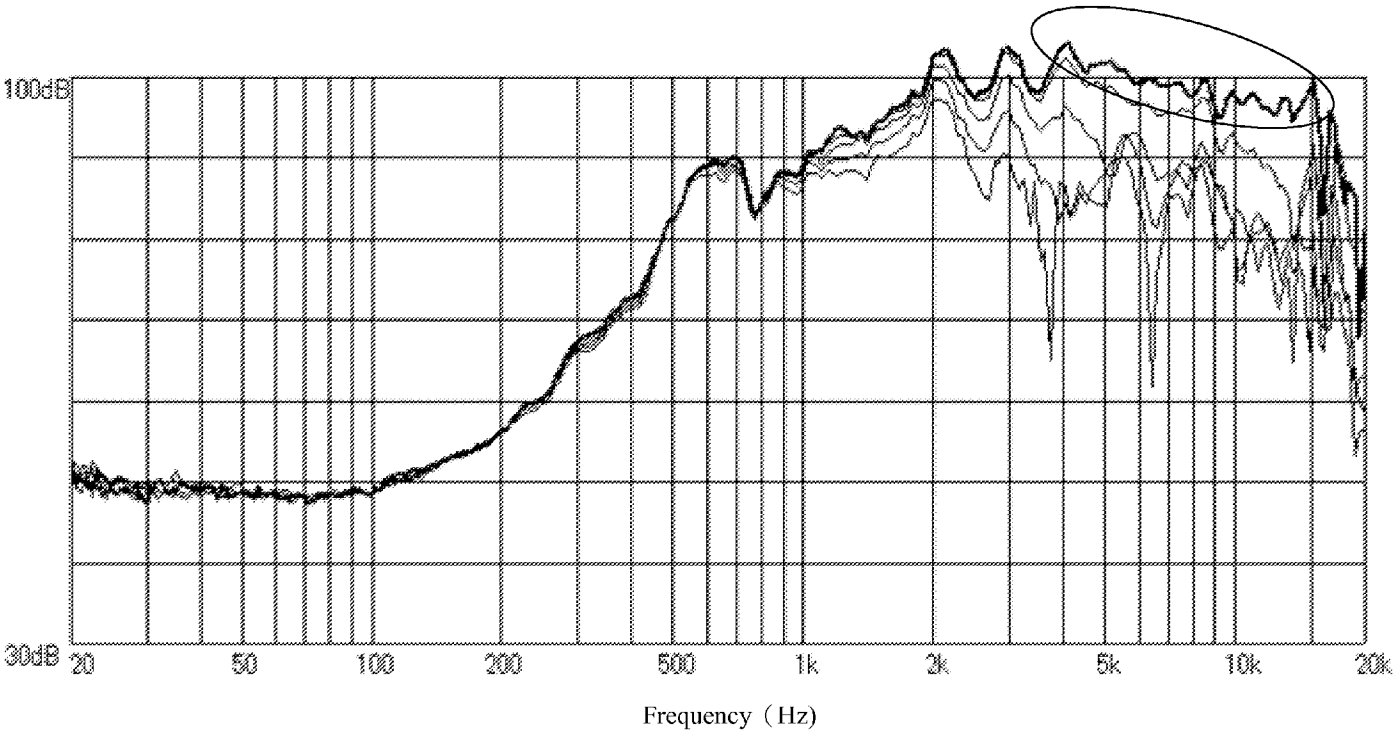
FIG.8C PRIOR ART
FIG. 8C illustrates a high-frequency attenuation measurement data figure of the first horn speaker of prior arts.
Figure 8D:
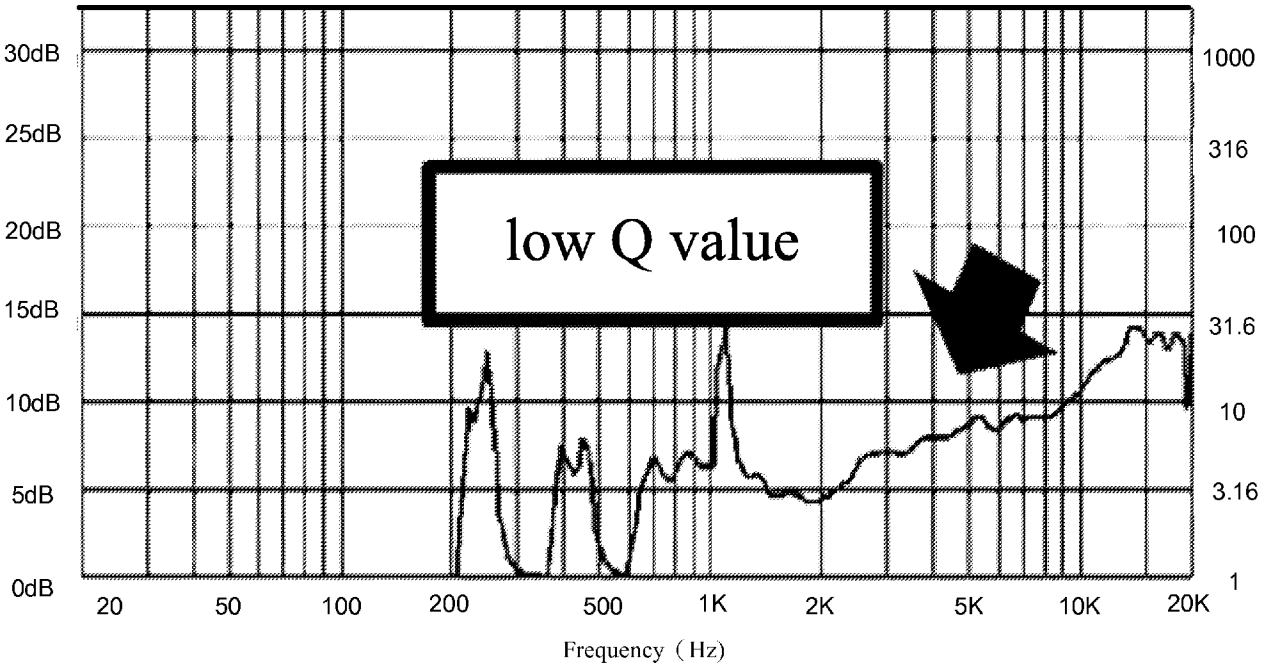
FIG.8D PRIOR ART
FIG. 8D illustrates a Q value measurement data figure of the first horn speaker of prior arts.
Figure 9A:
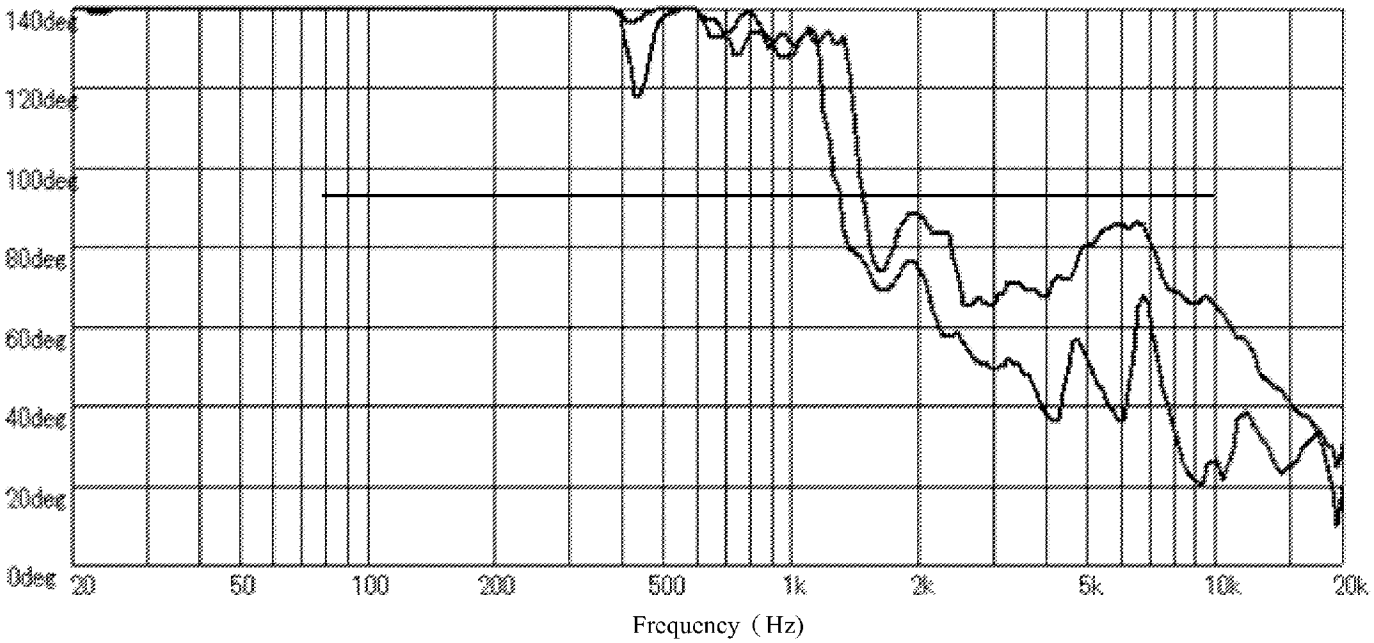
FIG.9A PRIOR ART
FIG. 9A illustrates a phase and frequency measurement data figure of a directivity of the second horn speaker of prior arts.
Figure 9B:
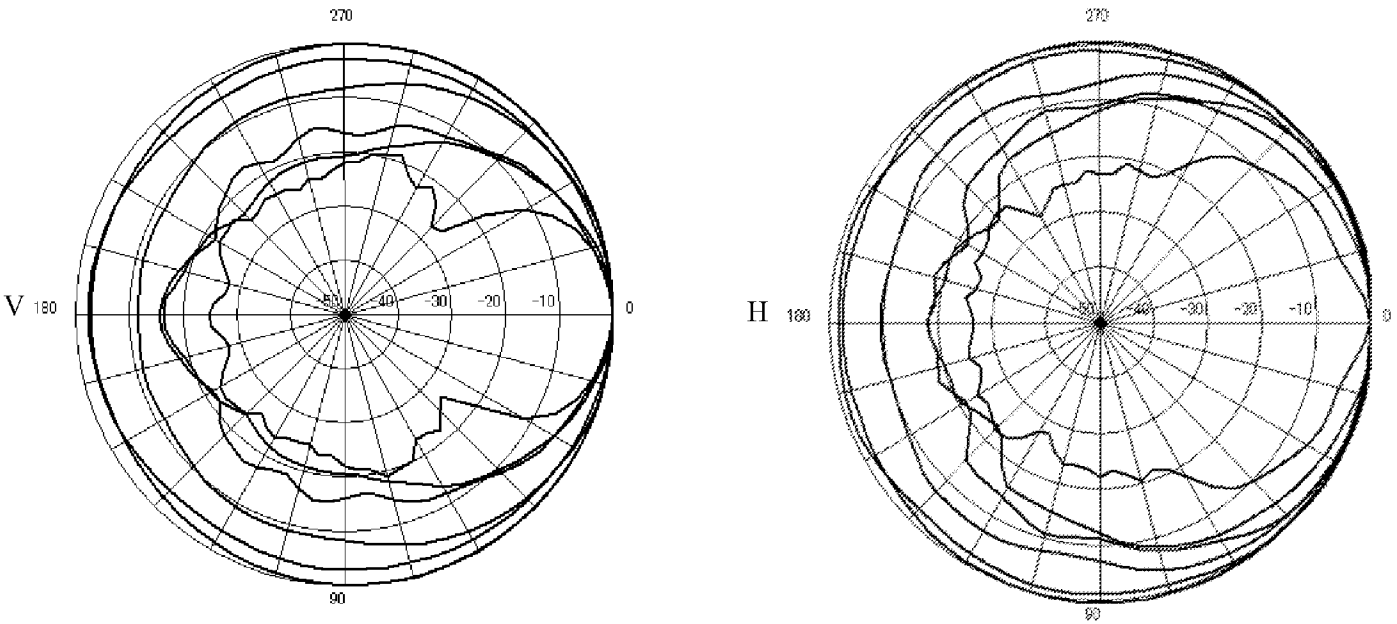
FIG. 9B PRIOR ART
FIG. 9B illustrates a radiation field measurement data figure of the directivity of the second horn speaker of prior arts.
Figure 9C:
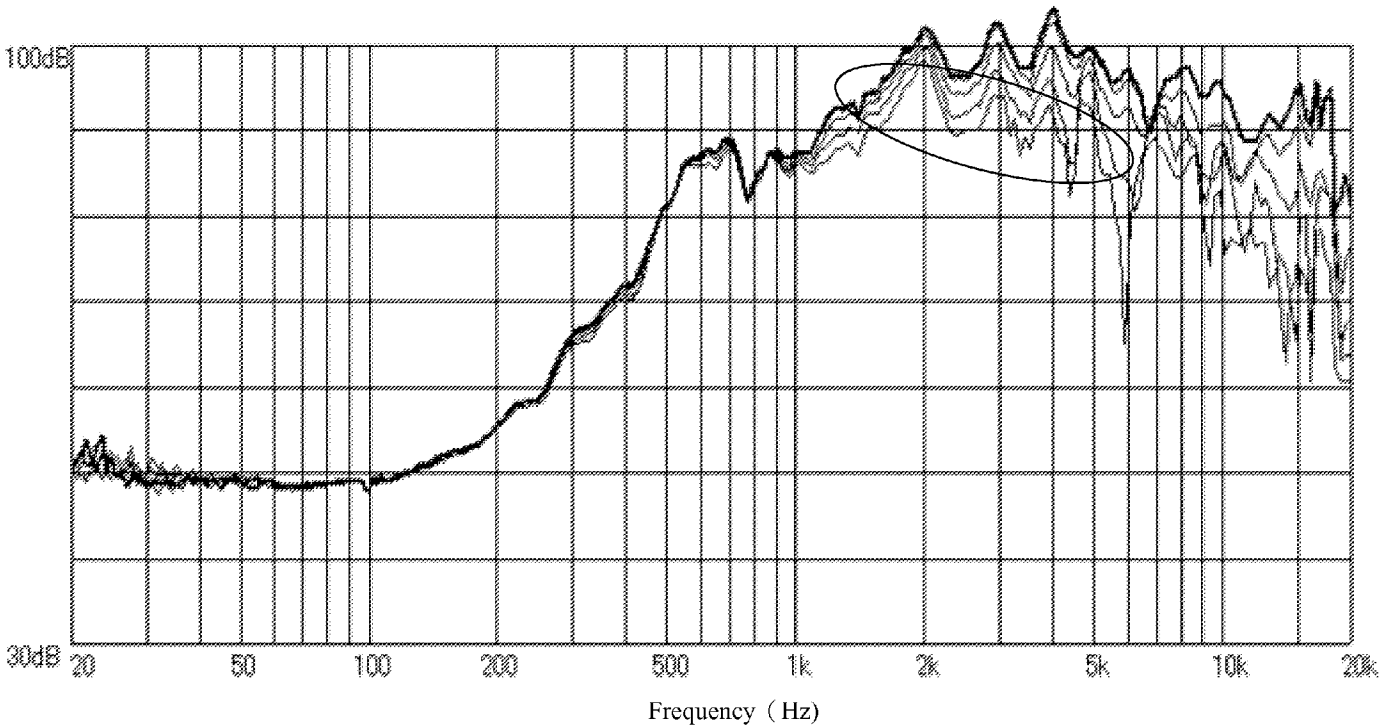
FIG.9C PRIOR ART
FIG. 9C illustrates a high-frequency attenuation measurement data figure of the second horn speaker of prior arts.
Figure 9D:
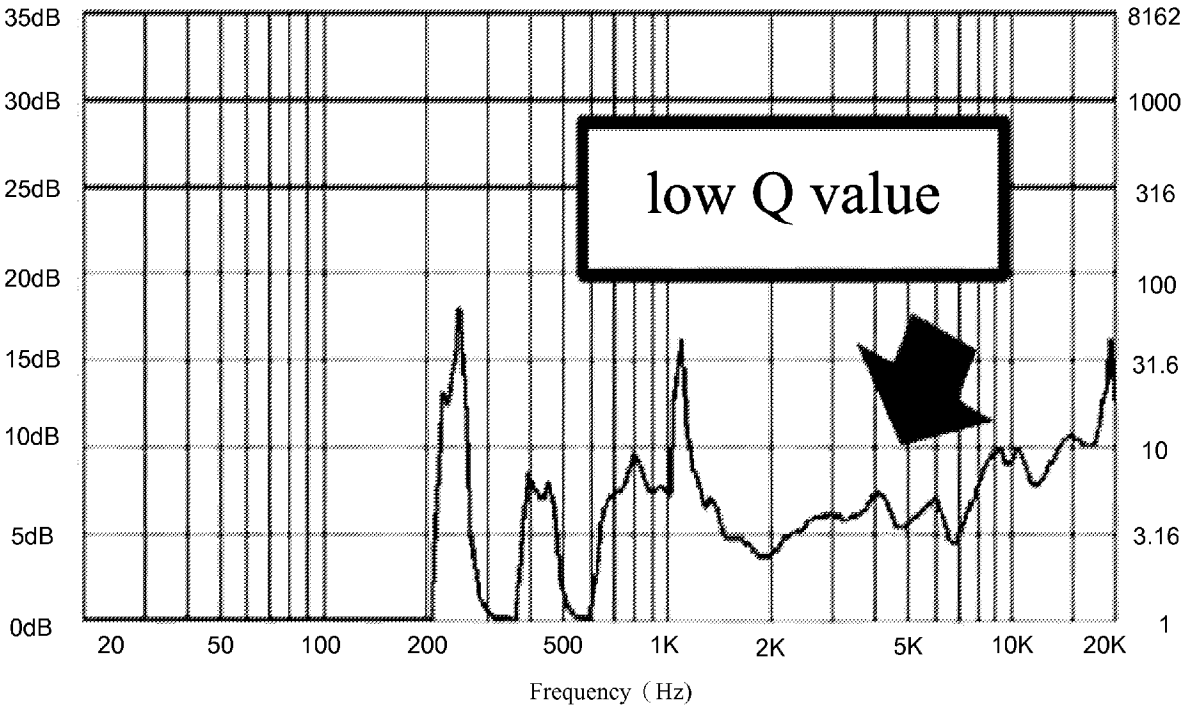
FIG.9D PRIOR ART
FIG. 9D illustrates a Q value measurement data figure of the second horn speaker of prior arts.
Figure 10A:
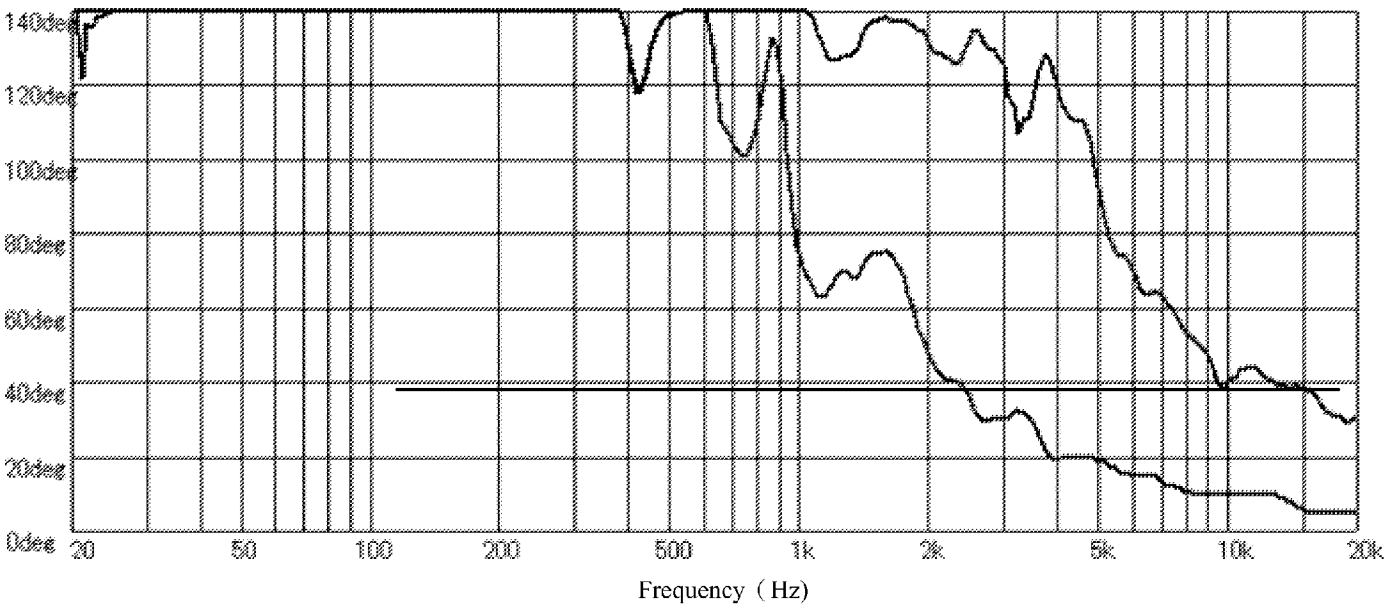
FIG.10A PRIOR ART
FIG. 10A illustrates a phase and frequency measurement data figure of a directivity of the third horn speaker of prior arts.
Figure 10B:
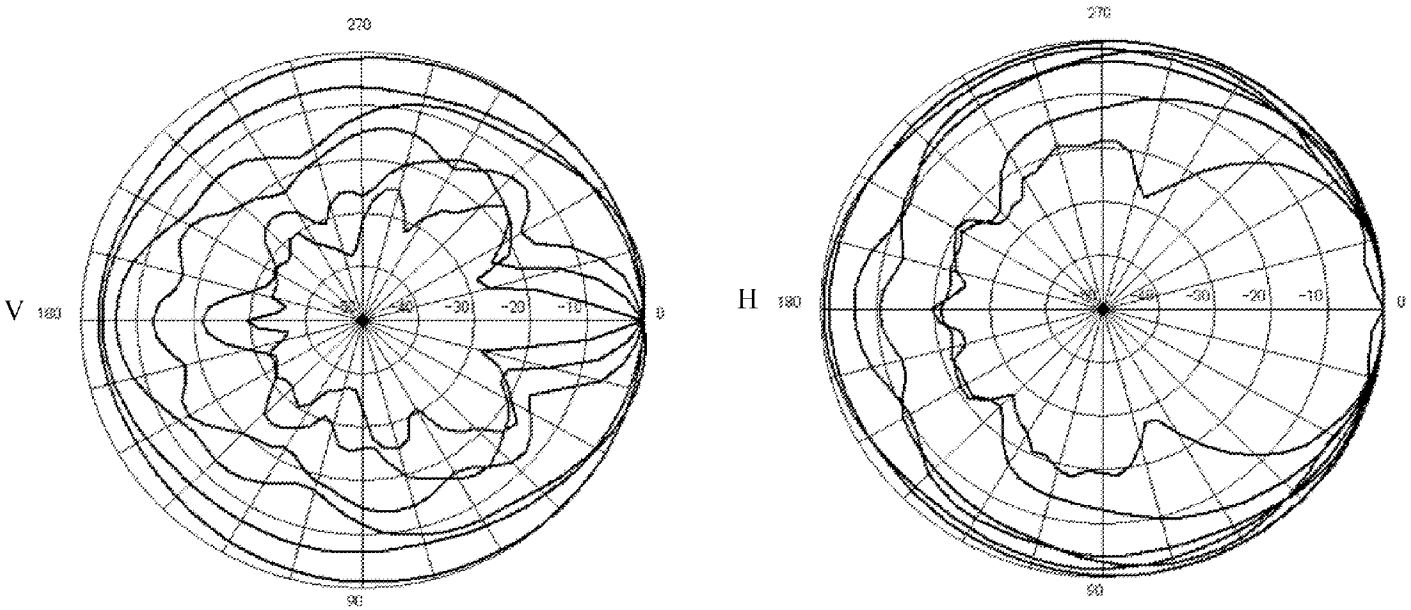
FIG.10B PRIOR ART
FIG. 10B illustrates a radiation field measurement data figure of the directivity of the third horn speaker of prior arts.
Figure 10C:
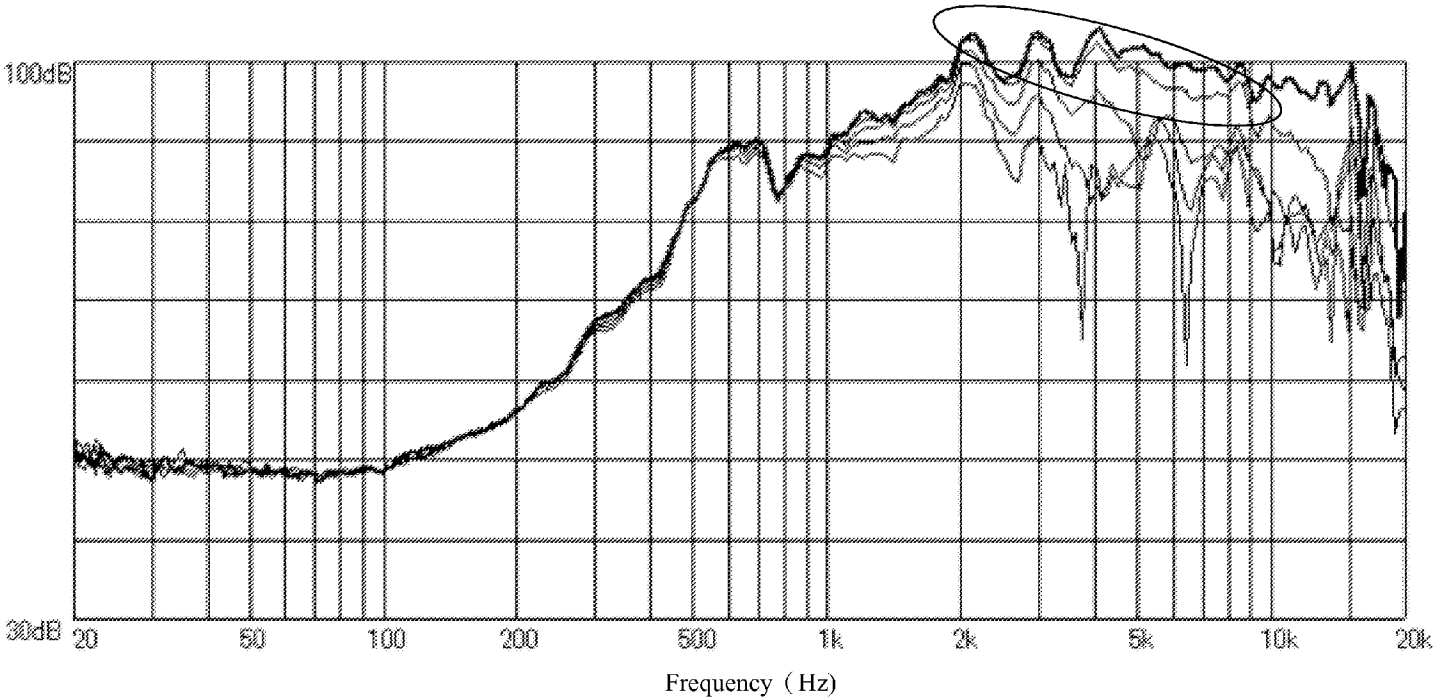
FIG.10C PRIOR ART
FIG. 10C illustrates a high-frequency attenuation measurement data figure of the third horn speaker of prior arts.
Figure 10D:
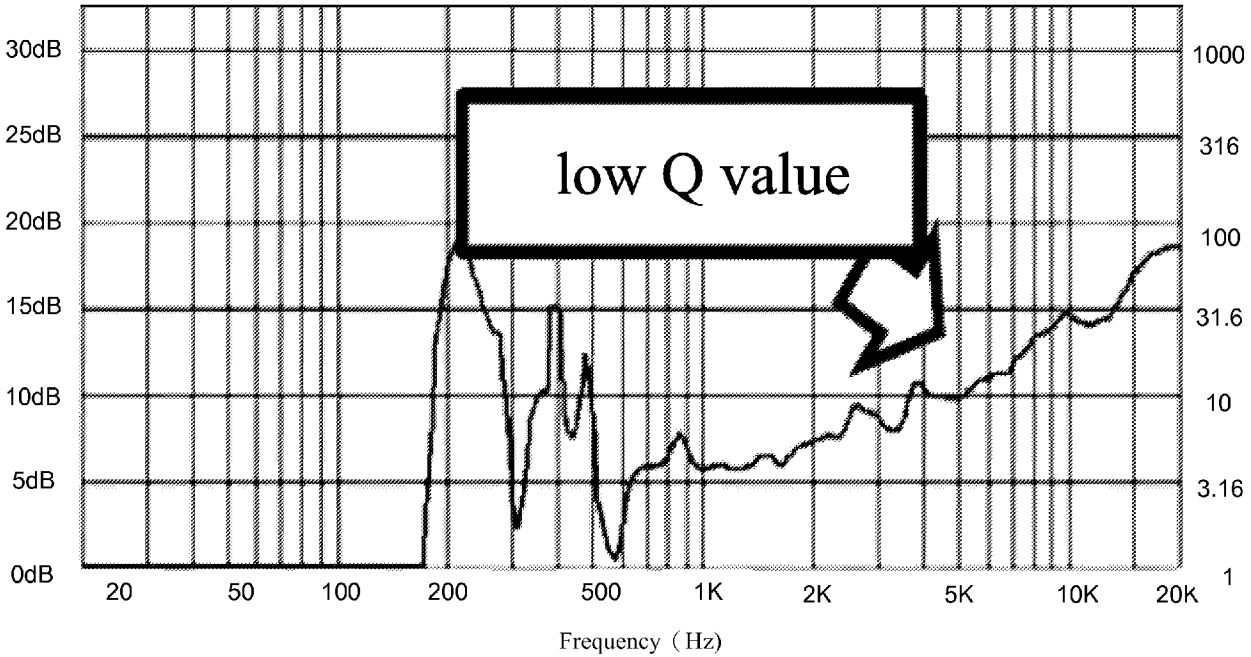
FIG.10D PRIOR ART
FIG. 10D illustrates a Q value measurement data figure of the third horn speaker of prior arts.
Figure 11A:
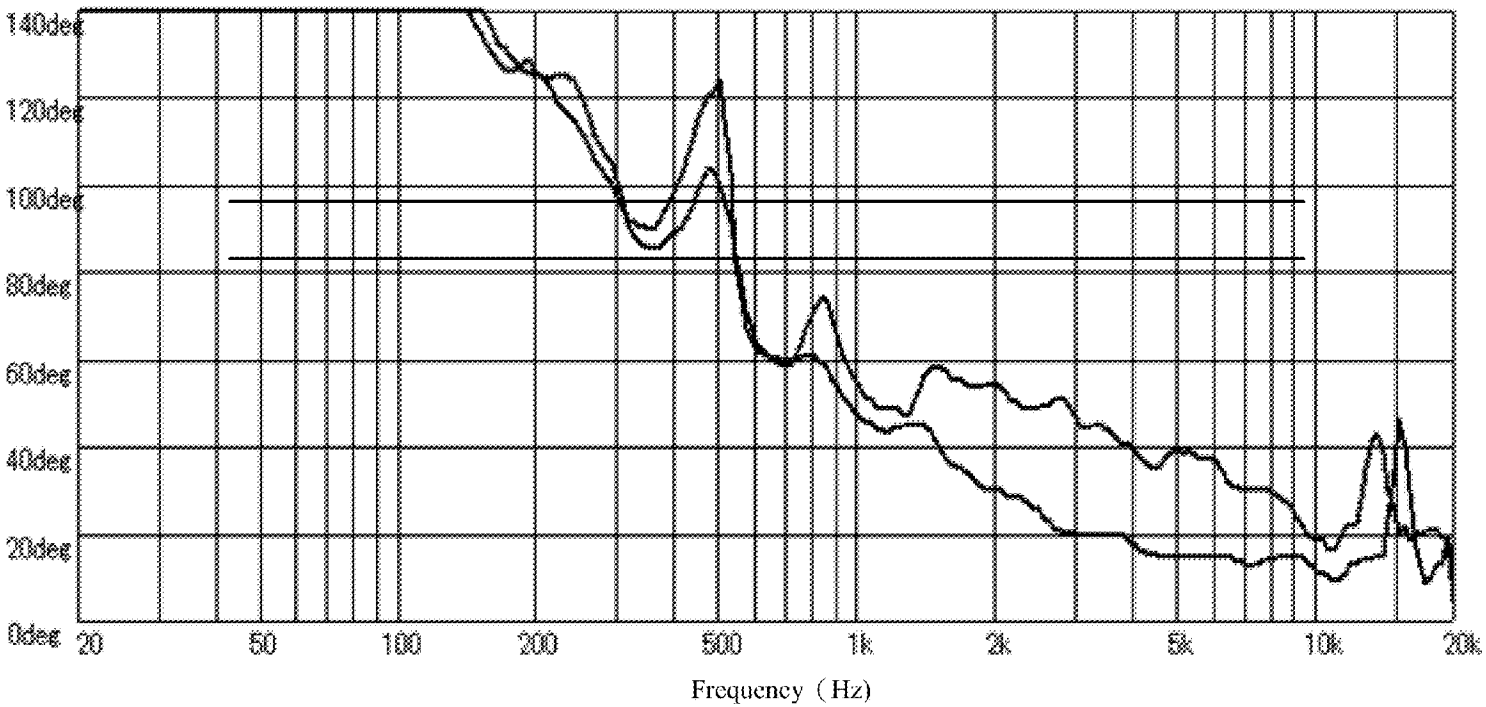
FIG. 11A illustrates a phase and frequency measurement data figure of a directivity of the horn amplifier of the present invention.
Figure 11B:
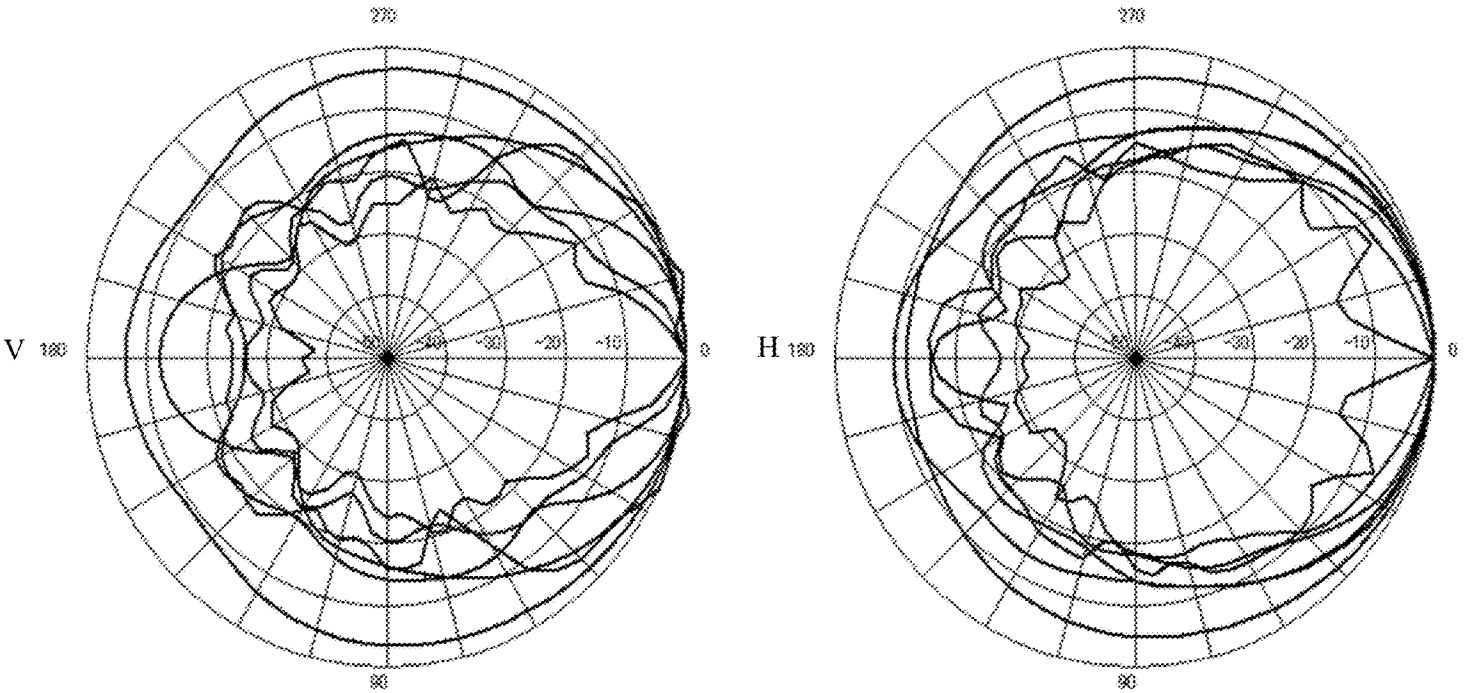
FIG. 11B illustrates a radiation field measurement data figure of the directivity of the horn amplifier of the present invention.
Figure 11C:
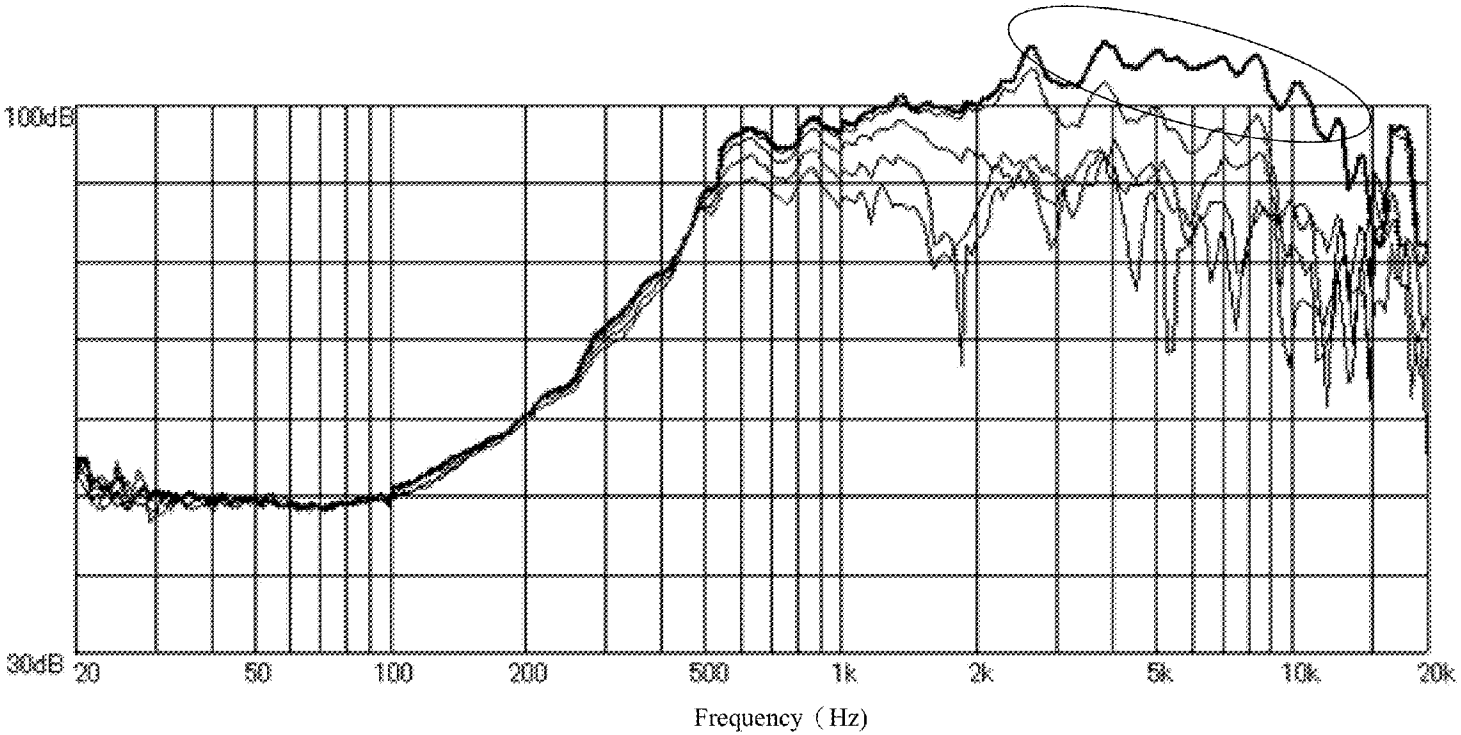
FIG. 11C illustrates a high-frequency attenuation measurement data figure of the horn amplifier of the present invention.
Figure 11D:
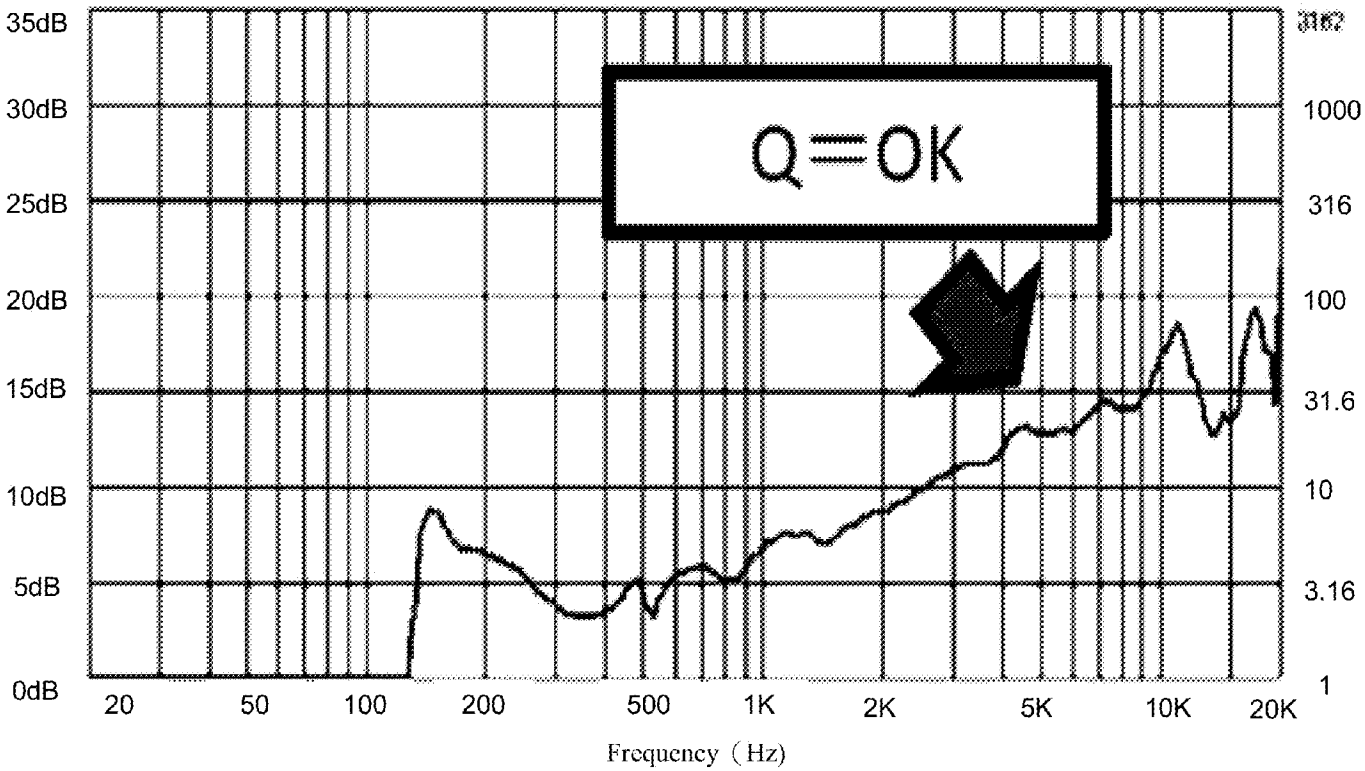
FIG. 11D illustrates a Q value measurement data figure of the horn amplifier of the present invention.

The major difference between the horn amplifier of the present invention and regular horn speakers is the structure of the sound-guide board 113. As shown in FIG. 5, FIG. 6 and FIG. 7, there are three prior horn speakers 2, 3 and 4. The first horn speaker 2 internally has a plurality of diffusers 22 near a plurality of opens 23 respectively. Thus, the sound waves will be scattered by the diffusers 22 while the sound waves transmit out from a speaker member 21. The second horn speaker 3 internally has a plurality of straight tubes 32. Thus, the sound wave will go straightly to a plurality of opens 33 along the straight tubes 32 while the sound waves transmit out from a speaker member 31. The third horn speaker 4 internally has a rhombus member 42. Thus, the sound waves will transmit toward up along the two sides of the rhombus member 42 and transmit out toward an open 43 along the other two sides of the rhombus member 42.

From the view of structure, there are differences between the horn amplifier of the present invention and the three prior horn speakers. Hence, for high-frequency attenuation, directivity and Q value, the three prior horn speakers and the horn is amplifier of the present invention are measured. FIG. 8A, FIG. 8B, FIG. 9A, FIG. 9B, FIG. 10A, FIG. 10B, FIG. 11A, and FIG. 11B are the directivity measurement data figures of the three prior horn speakers 2, 3 and 4 and the horn amplifier 1 of the present invention. FIG. 8C, FIG. 9C, FIG. 10C, and FIG. 11C are the high-frequency attenuation measurement data figures of the three prior horn speakers 2, 3 and 4 and the horn amplifier 1 of the present invention. FIG. 8D, FIG. 9D, FIG. 10D, and FIG. 11D are the Q value measurement data figures of the three prior horn speakers 2, 3 and 4 and the horn amplifier 1 of the present invention. According to FIG. 8A, FIG. 8B, FIG. 9A, FIG. 9B, FIG. 10A, FIG. 10B, FIG. 11A, and FIG. 11B, the directivities of the horn amplifier 1 and the third horn speaker 4 are better than the directivities of the first horn speaker 2 and the second horn speaker 3, and the positivity of the directivities of the horn amplifier 1 and the third horn speaker 4 disorders much more than the horn amplifier's 1. According to FIG. 8C, FIG. 9C, FIG. 10C, and FIG. 11C, the high-frequency of the horn amplifier 1 is better than the high-frequencies of the first horn speaker 2 and the second horn speaker 3. According to FIG. 8D, FIG. 9D, FIG. 10D, and FIG. 11D, for the Q value, the Q values of the horn amplifier 1, the second horn speaker 3 and the third horn speaker 4 are better while the sound is above 10 dB. The Q value of the horn amplifier 1 is the best at 13 dB. As aforesaid, the measurement results of the horn amplifier 1 of the present invention are the best, more particularly to the directivity.

Compared to other prior arts, the present invention has the advantages listed below. The present invention promotes the sound pressure and improve the high-frequency attenuation. More, is the present invention is lack of the disorder of the positivity of the directivity of any prior art. So the horn amplifier of the present invention is able to approach the functions that the prior arts can not have.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A horn amplifier comprising:

a horn; and at least one speaker member with at least one spherical sound source;

wherein the horn has at least one throat portion and one voice port opened from the throat portion toward outside, the bottom surface of the inner side of the throat portion of the horn having an open, the spherical sound source of the speaker member connecting with the open, the inner side of the throat portion having at least one S-type sound-guide board, the sound-guide board being made as a plurality of paths in order to let spherical sound waves from the spherical sound source of the speaker member enter into the paths, then the spherical sound waves being transformed into plane sound waves, the plane sound waves being delivered to outside through the inner structure of the horn; and the case of the throat portion is shaped as S-type, the inner side of the throat portion having two S-type walls.

2. The horn amplifier according to claim 1, wherein the S-type sound-guide board is assembled by two guide board.

3. The horn amplifier according to claim 1, wherein the two sides of the guide board of the S-type sound-guide board connect with the two S-type walls respectively.

4. The horn amplifier according to claim 2, wherein the two sides of the guide board of the S-type sound-guide board connect with the two S-type walls respectively.

5. The horn amplifier according to claim 1, wherein the spherical sound waves from the spherical sound source of the speaker member enter into the paths made by the S-type sound-guide board, then the spherical sound waves being transformed into plane sound waves so as to lower high-frequency attenuation of outputting the sound waves.

* * * * *